US007946862B2

(12) United States Patent
Schluter

(10) Patent No.: US 7,946,862 B2
(45) Date of Patent: May 24, 2011

(54) CABLE LADDER SPIKED BONDING STRAP

(75) Inventor: Robert Schluter, Kinnelon, NJ (US)

(73) Assignee: Middle Atlantic Products, Inc., Fairfield, NJ (US)

( * ) Notice: Subject to any disclaimer, the term of this patent is extended or adjusted under 35 U.S.C. 154(b) by 184 days.

(21) Appl. No.: 12/462,080

(22) Filed: Jul. 29, 2009

(65) Prior Publication Data

US 2011/0028027 A1 Feb. 3, 2011

(51) Int. Cl.
*H01R 13/648* (2006.01)

(52) U.S. Cl. ..... 439/100; 439/803

(58) Field of Classification Search ..... 439/92, 439/94, 402, 411, 78, 98, 100, 803, 431
See application file for complete search history.

(56) References Cited

U.S. PATENT DOCUMENTS 4,114,977 A * 9/1978 Polidori ..... 439/791
4,857,020 A * 8/1989 Crosby ..... 439/783
5,152,701 A * 10/1992 Polidori ..... 439/791
6,011,218 A * 1/2000 Burek et al. ..... 174/40 CC
6,533,605 B1 * 3/2003 Reuter ..... 439/431
6,986,673 B2 * 1/2006 de la Borbolla ..... 439/100
7,160,142 B2 * 1/2007 Hughes et al. ..... 439/479
2006/0257229 A1 11/2006 Bucciferro et al.

OTHER PUBLICATIONS

Tapped Rail Bonding Stud Kits—Panduit Network and Electrical Solutions; http://www.panduit.com/Products/ProductOverviews/ProductSearch/index.htm; Aug. 14, 2008; 1 pg.
Panduit Corp. Tinley Park , Illinois; Tapped Rail Bonding Stud Kits, Customer Drawing , No. C41700; Feb. 2007; 1 pg.

* cited by examiner

*Primary Examiner* — Neil Abrams
*Assistant Examiner* — Phuongchi T Nguyen
(74) *Attorney, Agent, or Firm* — Drinker Biddle & Reath LLP

(57) ABSTRACT

A grounding or bonding assembly comprising a strap or wire having multiple ends, with at least one end electrically connected to a clamp. The clamp includes a clamping means such as a screw and a penetrating means such as a spike. When the clamp is mounted on a structure and pressure is applied by means of the screw, the spike digs into the structure's surface and creates a low impedance electrical connection.

18 Claims, 6 Drawing Sheets

CABLE LADDER SPIKED BONDING STRAP

FIELD OF THE INVENTION

The present invention relates to an attachment or fastening system for use in securing two or more structures and, more particularly, to a fastening system for providing electrical bonding through the secured structures after attachment.

BACKGROUND

There are a number of devices on the market for creating bonding and grounding paths between multiple structures because for certain structures, such as suspended cable ladders, it is important to provide an electrical connection or bond between the sections of the structure. This is particularly important in situations where a structure includes multiple sections, and where grounding each section separately would not be feasible.

For example, many electrical mounting assemblies such as cable ladders or conduits, are large and consist of multiple sections for ease of transport and assembly. In order to maintain safety, electrical grounding and bonding between those sections is generally required. Because many mounting devices have a protective paint coating, the direct attachment of sections using conventional nuts and bolts is not, in some cases, sufficient to provide a low-impedance electrical connection. As such, in order to provide adequate grounding, separate grounding wires are typically used to provide electrical continuity, providing a continuous and reliable path for electrical ground faults, high frequency leakage currents, and electrically bonding multiple structures together to form an extension of the "ground plane." One end of the grounding wire is attached to a first section of the assembly and the other end is attached to an adjacent section. In order to ensure a stable electrical connection, the protective coating (e.g., paint) of the mounting device is removed around the location of the grounding wire attachment. While this type of attachment is generally adequate for providing electrical grounding, the attachment of the grounding wires is time consuming and subject to error should the ground connection not be properly completed.

A product that was recently introduced by Panduit Corporation is referred to as the Tapped Rail Bonding Stud Kit and includes a nut and bolt arrangement with serrations or teeth formed integral to and on the bottom of the nut and bolt. That product is described in detail in U.S. Patent Publication No. 2006/0257229.

While the Panduit product does address the problem for breaking through the paint layer to reach the base metal, Applicant has determined that the product negatively impacts the appearance of the components and can create a corrosion source since the serrations are designed to remove a complete circular ring of paint exposing the bare metal. The ring of bare metal is susceptible to corrosion unless an anti-oxidant is applied. However, application of anti-oxidants is an additional assembly step and can be difficult to apply or in some cases not done at all.

SUMMARY OF THE INVENTION

A grounding/bonding assembly is disclosed that includes a strap or wire with ends, each end adapted for engagement by a fastener. The fastener physically attaches and electrically connects the end of the strap/wire to a clamp, which mounts to the electrical mounting assembly, such as a section of a cable ladder. The other end of the strap/wire is attached to a similar clamp, which mounts to another section of the electrical mounting assembly. Each clamp includes a pointed grounding projection or spike on the surface of the clamp facing the cable ladder section. On a section of the clamp opposite the spike (i.e., positioned so that the cable ladder section is between it and the spike) is a tightening means, such as a screw or bolt. When the tightening means is tightened and the clamp rigidly engages the cable ladder section, the spike presses through the ladder section's protective coating to form a stable electrical connection without unnecessarily exposing the bare base material of the ladder section to corrosion.

In one embodiment, the tightening means is a bolt having an Allen head, and the end that contacts the cable ladder is rounded so as to avoid damaging the protective coating. The bolt may have any type of head adapted for manual manipulation or tool engagement. The clamp preferably has roughly an inverted J-shape, wherein the strap is fastened to the extended portion of the clamp, and the cable ladder section is engaged by the opposite end of the clamp. While this shape is preferred, the clamp may be of any shape that is disposed at least partially around a part of the structure and allows for attachment of the strap. The fastener is preferably a nut engaging a threaded bolt or stud passing through the clamp and the strap end, respectively, so that the clamp and strap/wire end are secured in electrical contact when the fastener is tightened.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention there is shown in the drawings various forms which are presently preferred; it being understood, however, that this invention is not limited to the precise arrangements and instrumentalities particularly shown.

DETAILED DESCRIPTION

Figure 1:
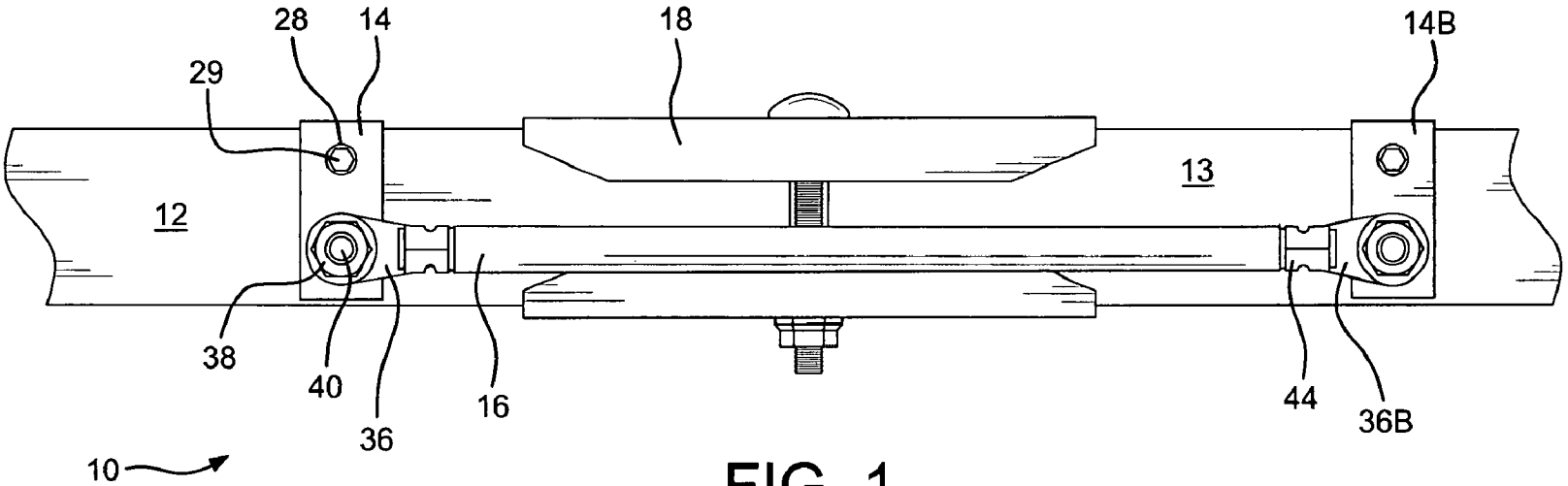
FIG. 1 is a side view of an embodiment of the grounding strap/wire of the present invention, showing the strap/wire in place between sections of a cable ladder.
Figure 3B:
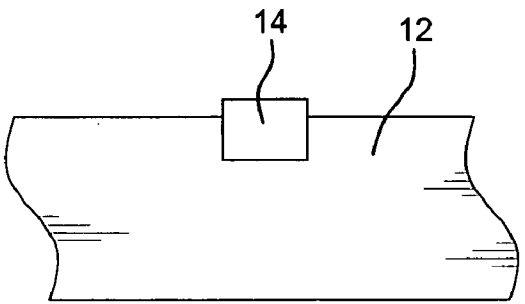
FIG. 3B is a side view of the opposite side of the clamp of FIG. 2 taken along lines 3B-3B.
Figure 3A:
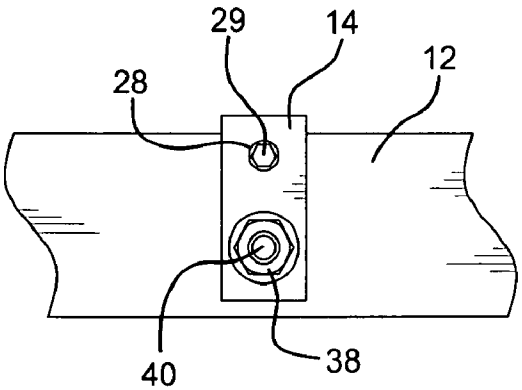
FIG. 3A is a side view of the clamp of FIG. 2 taken along lines 3A-3A.

FIG. 1 illustrates one embodiment of the grounding assembly 10 of the present invention as it is contemplated for use in attaching two sections of a cable ladder. As shown in FIG. 1, a grounding assembly 10 is mounted between cable ladder sections 12 and 13 by means of clamps 14. The clamps are located at opposite ends of a conductive strap or wire 16. For simplicity, the conductive wire or strap is referred to herein as a "wire." The grounding assembly provides an electrical connection between the ladder sections, but the sections are physically secured by a joint brace 18.

Figure 2:
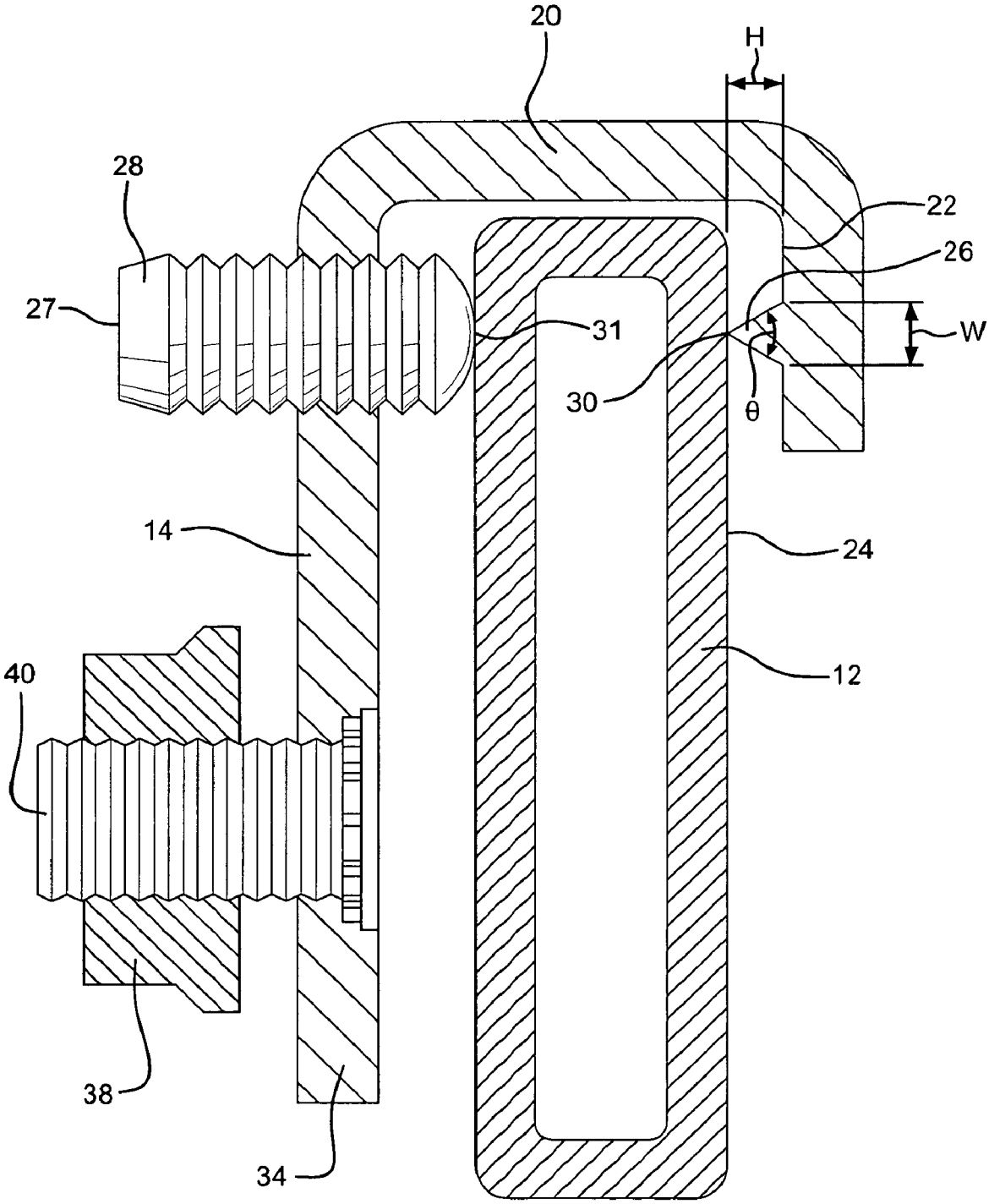
FIG. 2 is a cross-section view of an embodiment of the clamp used in the strap/wire of FIG. 1 taken along lines 2-2, showing the clamp mounted to a cable ladder.

As shown in FIGS. 1-3B, the clamps are shaped to fit over a part of a ladder section. In one embodiment, the clamp has roughly an inverted J-shape, as shown in FIG. 2, with an upper section that includes a first or outer leg 20A and a second or inner leg 20B. The upper section 20 of the clamp is designed to be disposed around the top edge of the ladder section 12 such that an inner surface 22 of the clamp is located adjacent to the ladder section's external surface 24. The clamp's upper section 20 includes at least one pointed projection or spike 26 extending preferably laterally from its inner surface 22 of the second leg 20B, and a clamping screw 28 extending through the first leg 20A substantially opposite from the spike. As such, upon installation, the ladder section 12 is located between the spike 26 and the clamping screw 28.

When the clamping screw is tightened against the side of the ladder, the spike on the opposite side of the clamp is forced into contact with the ladder surface. The head 27 of the clamping screw may include a recess 29 for receiving a Phillips head screwdriver, or may have a polygonal shape for engagement with a suitable tool such as an Allen key. The various configurations that can be formed in the screw head are well known to those skilled in the art and, therefore, no further discussion is needed. The tip 31 of the clamping screw is preferably rounded to allow concentration of the pressure created by the screw without damaging the ladder section's protective coating. The shape of the spike allows the tip to penetrate the ladder's protective coating so that the spike makes direct physical contact with the material of the ladder section. The direct physical contact ensures that the ladder section and the grounding assembly are suitably electrically connected. The removal of the protective coating caused by the spike is designed to be the minimum amount needed to allow electrical connectivity between the ladder and the grounding assembly. This minimizes the exposure of the ladder material to the outside environment and thus similarly minimizes the potential for corrosion or deterioration of the electrically conductive contact point of the ladder.

Figure 5A:
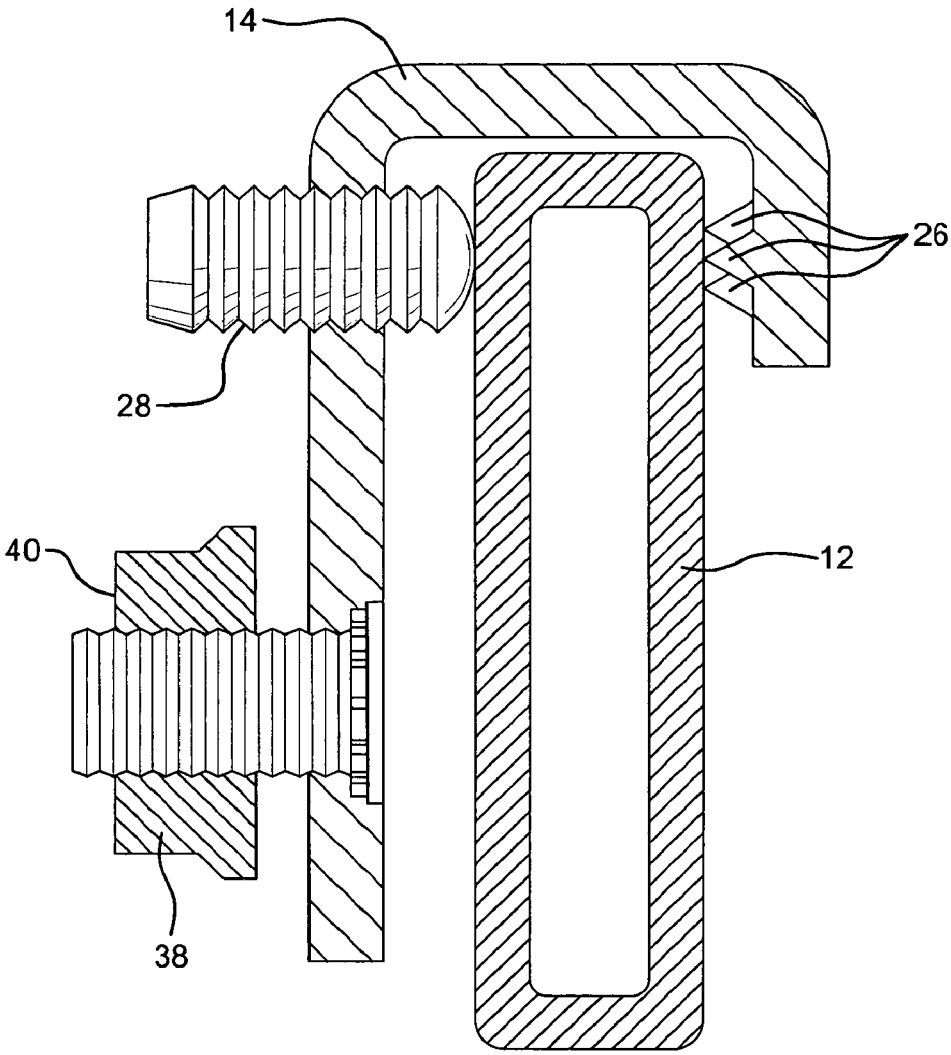
FIG. 5A is a cross-section view of an alternative embodiment of the clamp of FIG. 2.
Figure 5B:
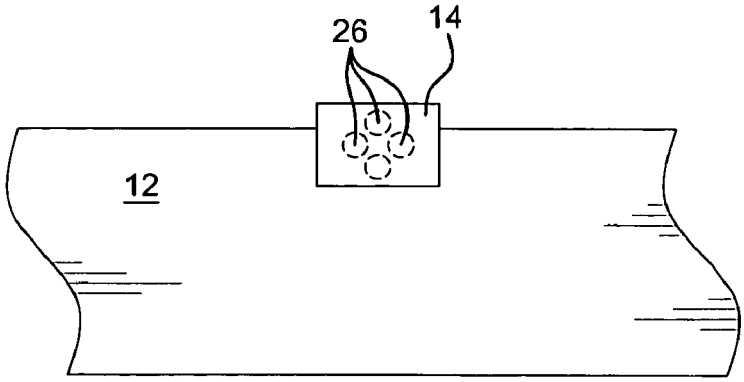
FIG. 5B is a side view of the alternative embodiment of FIG. 5A.

As shown in the alternative embodiment of FIGS. 5A and 5B, more than one spike may be used in each clamp, and the location and number of the spike or spikes may vary, although the location and number should be chosen so as to provide reliable displacement of and penetration through the protective coating during use and to provide sufficient electrical conductivity through the connection. In an alternative embodiment, multiple spikes may be arranged in a pattern having at its center the point on the clamp directly opposite the center of the clamping screw. Such an embodiment is shown in FIGS. 5A and 5B.

The alignment of the spike 26 axially with the clamping screw 28 provides more reliability that the load imposed on the clamp during tightening will translate substantially directly through the ladder to the spike as an axial piercing force into the ladder surface, thereby displacing and penetrating the protective coating locally and embedding the spike into the underlying metal material.

In one embodiment, the clamp 14 is made from stainless steel with a thickness of approximately $\frac{1}{8}^{th}$ inch. This is sufficiently thick enough to prevent deforming of the clamp during tightening of the clamping screw in this embodiment; however, the clamp may be constructed of any suitable size and material. Deformation is not desired because it can cause the spike to not embed properly and thus prevent formation of a stable electrical connection.

As discussed above, the spike 26 is preferably integrally formed with the clamp 14. In one preferred embodiment, the clamp is cast or formed in a die from a high strength electrically conductive material, such as steel, powdered metal, or other well known electrically conductive materials. It is also contemplated that the clamp could be formed using a stamping or machining process. As should be evident from the above discussion, the clamp should be manufactured with a suitable hardness and stiffness to achieve the desired penetration. If the clamp or spike is too hard, the clamp can snap or the spike can break when the clamp is tightened. However, if the clamp or spike is too soft, it may deform during tightening and fail to penetrate into the ladder material. Thus, proper hardening is needed. This can be achieved though a hardening or heat treat process after the clamp is formed. Preferably the clamp is manufactured such that the spike has a Rockwell hardness of between 30 and 80 (on the C scale) with a more preferred Rockwell hardness of approximately 58.

Figure 4A:
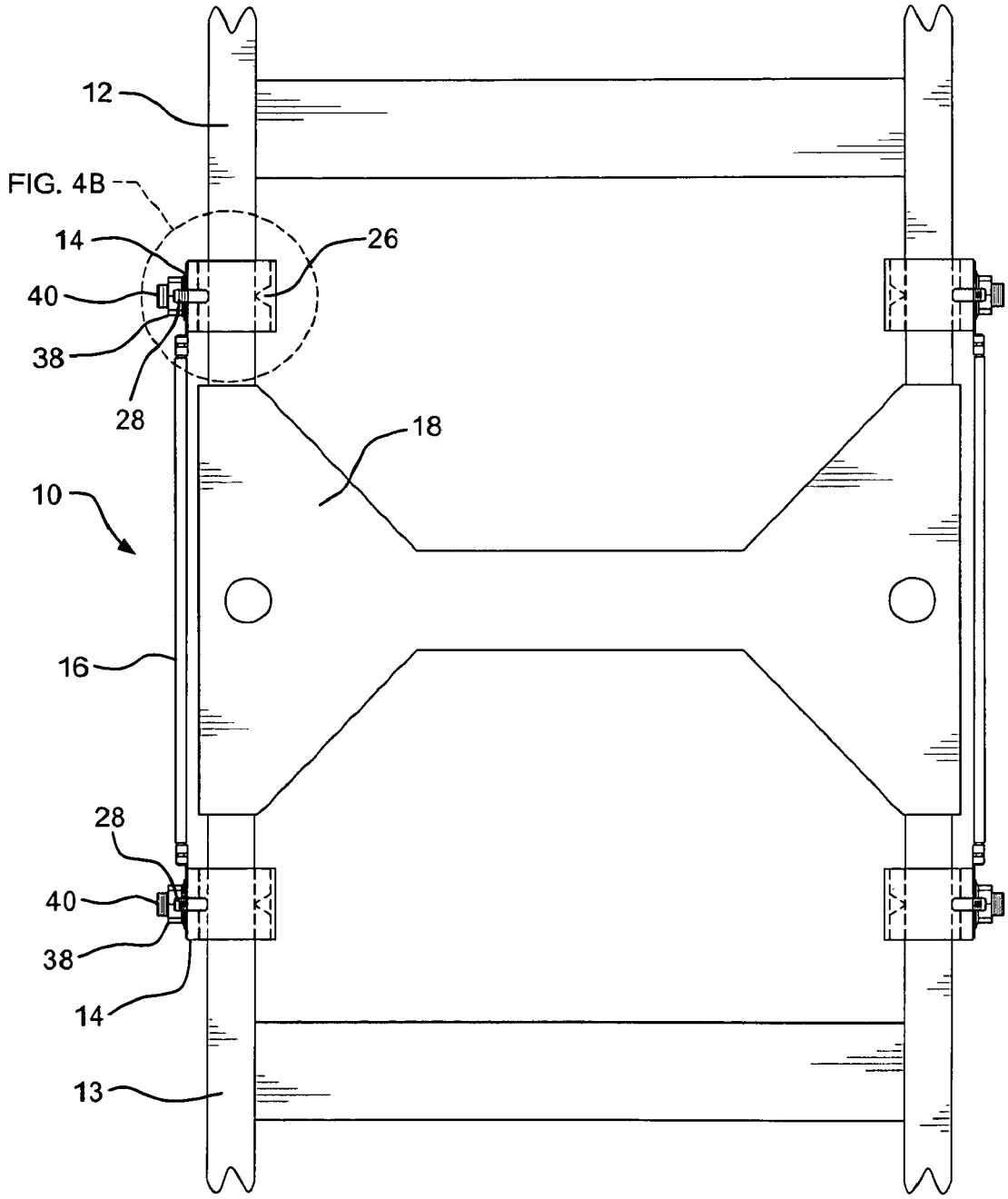
FIG. 4A is a top view of a joint between two cable ladder section, showing an embodiment of a grounding strap/wire of FIG. 1 attached to each side of the ladder.
Figure 4B:
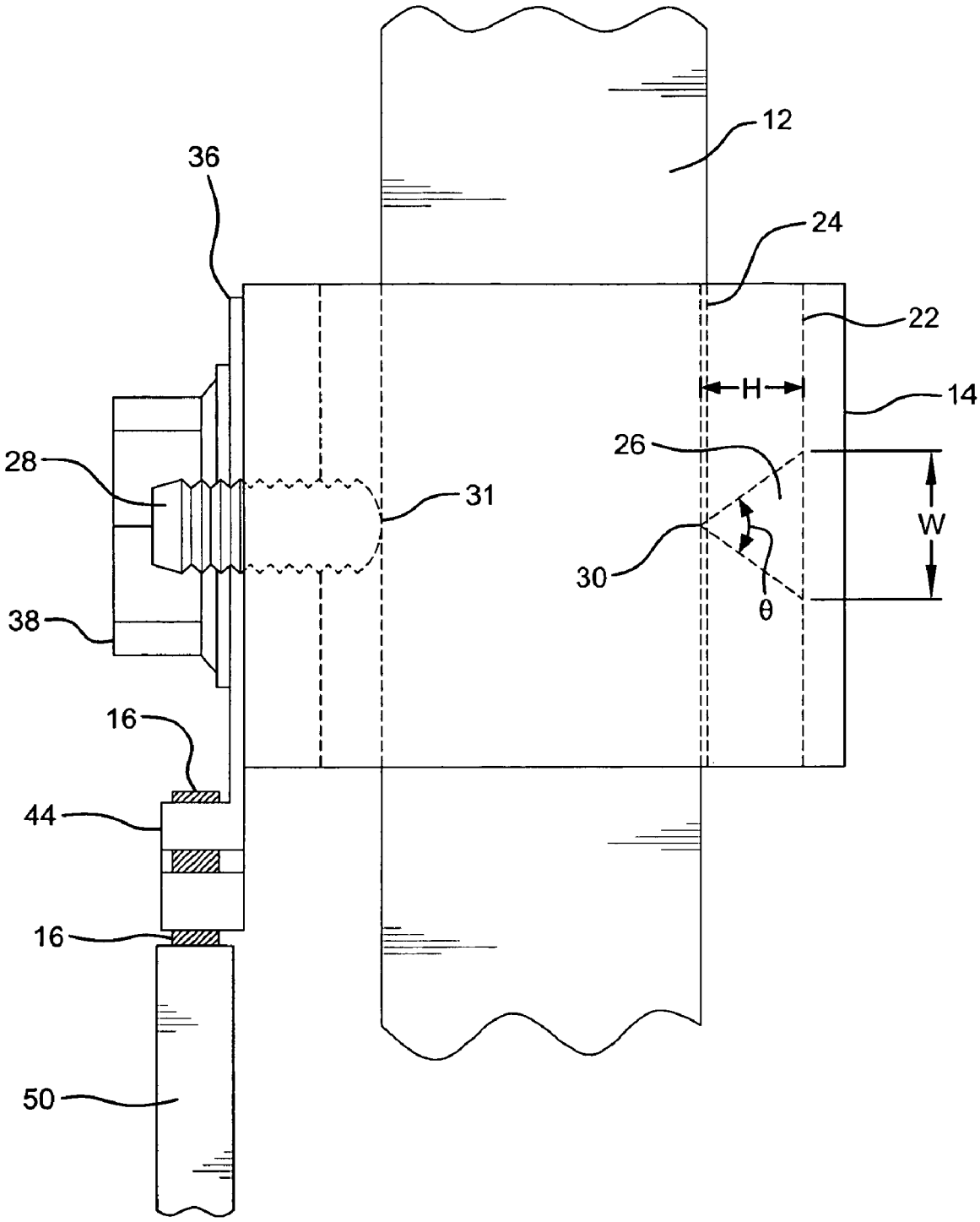
FIG. 4B is a close-up view of a portion of a strap/wire of FIG. 4A.

As shown in FIGS. 2 and 4B, the spike preferably has a height H from the clamp's inner surface 22 of about ⅛ inch and has a width W of about ⅛ inch at the flat surface, tapering preferably uniformly to the tip 30. Thus, in one embodiment, the cone has an inclusive angle θ of approximately 60 degrees. The shape and size of the spike may vary, however the spike must have a sufficiently sharp tip or edge to sever the protective coating. Also, the inclusive angle must be sufficiently small to provide the sharp piercing point, while still providing sufficient strength so as not to break during installation. A preferred angle θ in the present invention is between about 20 degrees and 120 degrees. More preferably, the inclusive angle is between 30 degrees and 80 degrees. Any narrower than 20 degrees could lead to premature breakage of the spike. Any larger than 120 degrees can lead to the spike failing to sufficiently penetrate the painted layer.

Although the preferred embodiment is a conical shaped spike, such as the one shown in FIG. 2, it should be apparent from the above discussion that a pyramidal (three, four or more sided) structure can be used as the spike provided the tip is designed to penetrate and displace the painted coating as it extends into the structure's base material. Furthermore, while a pointed spike is preferable, the spike can instead form a linear or knife edge. The knife edge is designed to dig into the protective coating during tightening, displacing the coating and penetrating into the base material.

Figure 6:
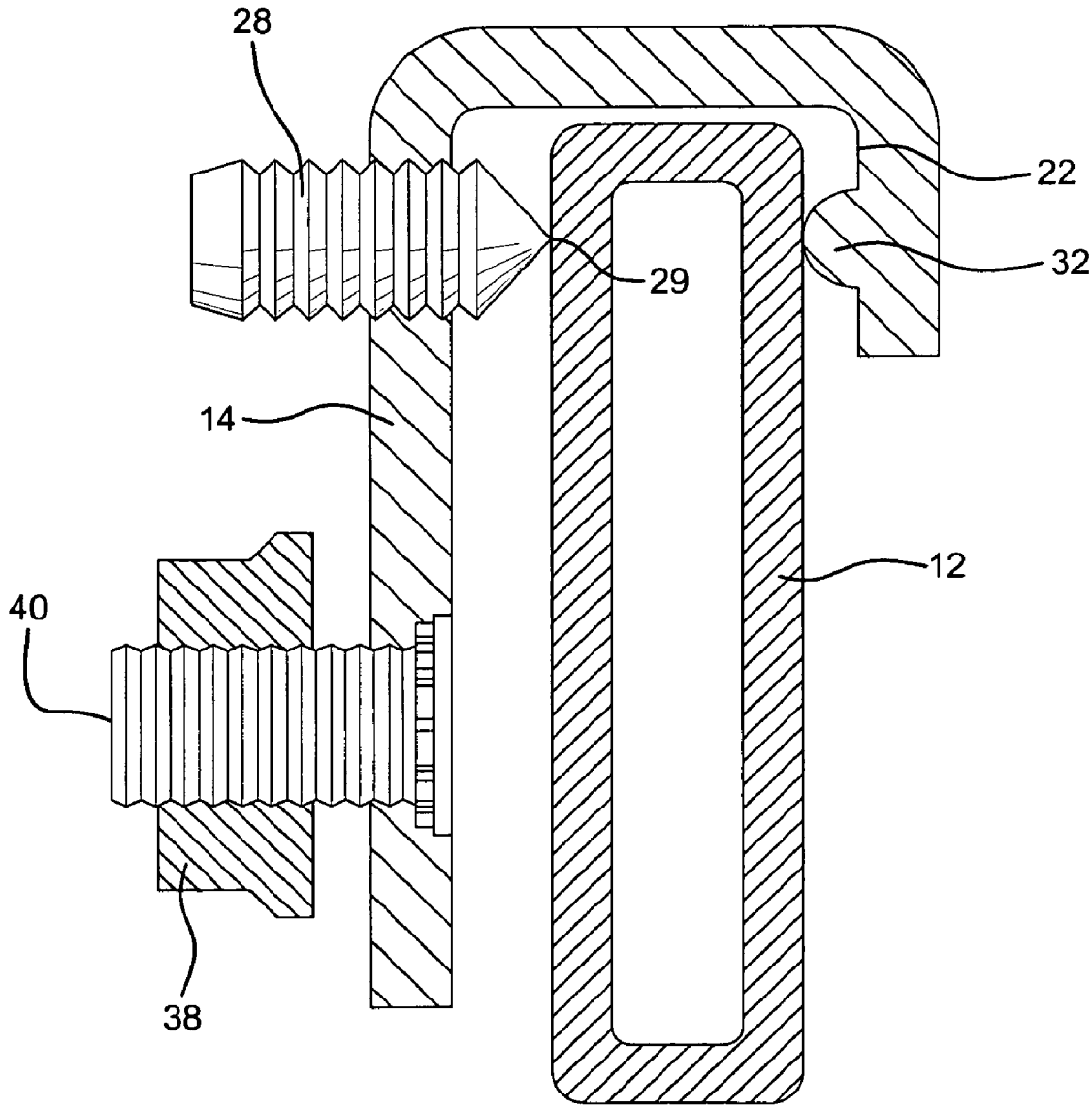
FIG. 6 is a cross-section view of a second alternative embodiment of the clamp of FIG. 2.

Alternatively or additionally, the clamping screw 28 may feature a spike on its end that contacts the ladder, whereby tightening the screw will force the end of the screw through the ladder's protective coating to form an electrical connection with the ladder material. In this embodiment, the other side of the clamp may or may not feature an integral spike. In another embodiment shown in FIG. 6, the clamping screw 28 features a spiked end 29 and the inner surface 22 of the clamp 14 features a bracing bump 32 located directly opposite the clamping screw 28, so that when the screw is tightened, the bump provides a stable point against which the ladder section may be clamped.

The clamp includes a lower section 34 which is designed to be provide a mounting location for electrically connecting a wire 16 via a terminal 36 and a fastener 38. The lower section 34 is an integral extension of the first leg of the upper section of the clamp. It should be readily apparent that the wire mounting location 34 need not be below the clamp screw 28, but could be located laterally to the side of the location of the clamping screw 28.

The wiring terminal is preferably a flat metal element, and is preferably removably fastened to the clamp by means of a fastener, which preferably engages a threaded bolt or stud 40 passing through the clamp's lower section 34, and a nut 42 that threads onto the bolt so as to secure the wiring terminal between it and the clamp.

While the wire and wiring terminal may be a single piece, for sizing flexibility and ease of assembly it may be desirable that they are separate pieces fastened together. In a preferred embodiment, the wiring terminal is secured to the wire 16 by a crimp connection of a type known in the art; however, the wire and terminal may be fastened by any suitable method that creates a low impedance electrical connection. Specifically, as shown in FIGS. 1 and 4B, the wiring terminal 36 includes a crimp loop 44 through which one end of the wire may pass. The crimp loop is crushed so as to secure the captured end of the wire to the terminal. The terminal is preferably made of a suitably conductive material, such as copper, although it can be made of any other desirable electrically-conductive material. In a preferred embodiment shown in FIG. 1, a second, identical terminal 36*b* and clamp 14*b* are located on the opposite end of the wire, and themselves attached to a second ladder section 13 in the manner herein described.

The wire is also preferably made of copper, although it may be constructed of any suitable electrically-conductive material. The wire can be of any suitable length, but is preferably no longer than necessary to create a low impedance electrical connection between two sections of the cable ladder. The wire is preferably covered by an insulating layer 50, which is preferably made from a flexible, non-conductive material such as plastic or rubber, but which may be made from any suitable material that protects the strap from damage or contact with the ladder or other objects.

Variations, modifications and other implementations of what is described herein will occur to those of ordinary skill in the art without departing from the spirit and scope of the invention. Accordingly, the invention is in no way limited by the preceding illustrative description.

What is claimed is:

1. A grounding or bonding assembly for providing low impedance electrical conductivity between multiple sections of a electrical cable structure, the grounding or bonding assembly comprising:

an electrically-conductive clamp including a mounting assembly for connecting to an electrically-conductive element, and a clamp portion having two legs that are electrically connected and shaped so as be able to extend around a section of the cable structure, the legs having inner surfaces that are positioned so as to face external surfaces of the cable structure on opposite sides of the cable structure section, the inner surface of one of the legs including at least one penetrating device protruding therefrom; and a clamping fastener threadingly engaged with one of the legs and extending therethrough, the fastener oriented so as to thread laterally toward the other leg of the clamp portion and toward an external surface of the cable structure during use, the threading of the fastener adapted to secure the clamp to the cable structure and to cause the penetrating device to penetrate into a surface of the cable structure.

2. The grounding or bonding assembly of claim 1, wherein the penetrating device is formed on the inner surface of one of the legs of the clamp and the fastener is threaded into the other of the legs of the clamp and toward the penetrating means, the penetrating device and the fastener having central axes that are substantially aligned.

3. The grounding or bonding assembly of claim 1, wherein the device is formed on an inner tip end of the fastener, the fastener being movable so that the tip is adapted to penetrate into the cable structure during use.

4. The grounding or bonding assembly of claim 1, wherein the penetrating device is at least one projection formed integrally with and projecting from the inner surface of one leg of the clamp.

5. The grounding or bonding assembly of claim 1, wherein the body of the clamp has an average thickness of about 0.125 inch.

6. The grounding or bonding assembly of claim 1, wherein the penetrating device is multiple pointed projections arranged so that the center of the pattern is aligned with the axis of the fastener.

7. The grounding or bonding assembly of claim 6, wherein the pointed projections are conically shaped and substantially equally spaced at a common radius so that the projections lie substantially on a medial circumference, each projection having a height of approximately 0.125 inches and have a tip end with an inclusive angle of approximately 60 degrees, the clamp having a thickness of approximately 0.125 inches.

8. The grounding or bonding assembly of claim 1, further comprising an electrically-conductive element including at least two ends, at least one end being attached and electrically connected to the mounting assembly, wherein the mounting assembly includes a fastener for securing the end to the clamp.

9. The grounding or bonding assembly of claim 8, wherein the end of the conductive element includes a conductive loop that is attached to a wire through a crimped connection.

10. The grounding or bonding assembly of claim 8, wherein the conductive element is removably attached to the first area of the clamp by mounting assembly.

11. The grounding or bonding assembly of claim 8, wherein a second end of the conductive element is electrically connected to a second clamp, and wherein the second clamp is electrically connected to a second cable structure.

12. The grounding or bonding assembly of claim 1, wherein the penetrating device includes a pointed conical projection located on the inner surface of one of the legs of the clamp and the fastener is threaded into the other of the legs of the clamp and toward the conical projection.

13. The grounding or bonding assembly of claim 12, wherein the pointed projection has a height of approximately 0.125 inches and has a tip end with an inclusive angle of between approximately 20 degrees and 120 degrees.

14. The grounding or bonding assembly of claim 13, wherein the inclusive angle is between approximately 30 degrees and 80 degrees.

15. The grounding or bonding assembly of claim 13, wherein the inclusive angle is approximately 60 degrees, and wherein the projection has a Rockwell hardness of approximately 58 on the Rockwell C scale.

16. A grounding or bonding assembly for providing low impedance electrical grounding between multiple cable ladder structures, the grounding or bonding assembly comprising:

at least two clamps, each clamp including:

a clamp portion having two legs that are connected by an intermediate section and shaped so as be able to extend around a section of one of the cable structures, the legs having conductive inner surfaces that are positioned so as to face external surfaces of the cable structure on opposite sides of the cable structure section, the inner surface of one of the legs including at least one projection extending outward therefrom and toward the other leg;

a clamping fastener threadingly engaged with the other leg and extending through a hole formed in the leg, the fastener oriented so as to thread laterally toward the other leg of the clamp portion and toward an external surface of the cable structure during use, the threading of the fastener adapted to secure the clamp to the cable structure and to cause the projection to penetrate into a surface of the cable structure; and an electrically-conductive element including two terminal ends, each end being electrically connected to one of the clamps.

17. The grounding or bonding assembly of claim 16 wherein each terminal end is connected to an associated clamp by a threaded fastener that is mounted to and protrudes outward from a leg on the clamp, the terminal end being secured to the fastener with a bolt.

18. A method of providing a low impedance electrical connection between two structures, the method comprising the steps of:

providing first and second clamps according to claim 16;

placing the first clamp onto a section of a first cable ladder structure;

placing the second clamp onto a section of a second cable ladder structure;

securing an electrically-conductive element to each of the clamps; and clamping each clamp onto the associated cable ladder structure so as to force the projection to penetrate a discrete distance into the surface of the associated cable ladder structure.

* * * * *